US006629663B1

(12) United States Patent
Bettendorf

(10) Patent No.: US 6,629,663 B1
(45) Date of Patent: Oct. 7, 2003

(54) WOUND ROLL VIBRATION DETECTION SYSTEM

(75) Inventor: Robert Bettendorf, Appleton, WI (US)

(73) Assignee: Valmet Corporation, Appleton, WI (US)

( * ) Notice: Subject to any disclaimer, the term of this patent is extended or adjusted under 35 U.S.C. 154(b) by 167 days.

(21) Appl. No.: 09/756,665

(22) Filed: Jan. 10, 2001

(51) Int. Cl.[7] ..... B65H 26/02
(52) U.S. Cl. ..... 242/534; 242/907
(58) Field of Search ..... 242/534, 534.2, 242/542, 907; 73/659, 660

(56) References Cited

U.S. PATENT DOCUMENTS

| | | | | |
|---|---|---|---|---|
| 2,760,369 A | | 8/1956 | Vanator | |
| 3,238,786 A | | 3/1966 | Pellicciotti | |
| 3,393,557 A | | 7/1968 | Brown et al. | |
| 3,641,550 A | | 2/1972 | Lynas et al. | |
| 4,047,676 A | * | 9/1977 | Dahl et al. | 242/907 |
| 4,095,755 A | * | 6/1978 | Snygg et al. | 242/907 |
| 4,167,877 A | | 9/1979 | Avery | |
| 4,302,813 A | | 11/1981 | Kurihara et al. | |
| 4,352,293 A | | 10/1982 | Kurihara et al. | |
| 4,453,407 A | | 6/1984 | Sata et al. | |
| 4,482,859 A | | 11/1984 | Fournier | |
| 4,607,529 A | | 8/1986 | Morey | |
| 5,069,071 A | | 12/1991 | McBrien et al. | |
| 5,167,002 A | | 11/1992 | Fridhandler | |
| 5,582,192 A | | 12/1996 | Williams, III | |
| 5,588,721 A | | 12/1996 | Asana et al. | |
| 5,679,900 A | | 10/1997 | Smulders | |
| 5,744,723 A | | 4/1998 | Piety | |
| 5,768,985 A | | 6/1998 | Lehtovirta et al. | |
| 5,909,855 A | | 6/1999 | Jorkama et al. | |
| 5,915,297 A | | 6/1999 | Lehtovirta et al. | |
| 5,955,674 A | | 9/1999 | McGovern et al. | |
| 5,971,315 A | | 10/1999 | Kojo | |
| 6,156,158 A | | 12/2000 | Kustermann | |
| 6,387,214 B1 | * | 5/2002 | Kustermann et al. | |

FOREIGN PATENT DOCUMENTS

| | | |
|---|---|---|
| EP | 0 839 743 | 5/1998 |
| JP | 63267650 | 11/1988 |
| JP | 06080289 | 3/1994 |

* cited by examiner

*Primary Examiner*—William A. Rivera
(74) *Attorney, Agent, or Firm*—Piper Rudnick

(57) ABSTRACT

An improved system for detecting and controlling vibration of a wound roll in a winding machine includes a programmable controller to which the line speed of a web, diameter of the wound roll and vibration of the wound roll feedback is provided. The programmable controller computes the wound roll rotational frequency from the line speed and diameter feedback and uses this information to filter the vibration feedback so that the components of the vibration due solely to the rotation of the wound roll are isolated. The isolated vibration components are provided to a level detector which decelerates the winding machine when a predetermined vibration level is reached. In one embodiment, the rotational frequency is used to calculate coefficients for a band pass filter which filters the vibration feedback. In a second embodiment, a Fast Fourier Transform analysis is performed upon the vibration feedback and the rotational frequency is used as a pointer to identify the amplitude of the component due to the rotation of the wound roll.

30 Claims, 5 Drawing Sheets

WOUND ROLL VIBRATION DETECTION SYSTEM

BACKGROUND OF THE INVENTION

The invention relates, generally, to devices for winding webs of material and, more particularly, to an improved wound roll vibration detection system.

Winding machines are used in the paper industry for winding webs of paper to and from rolls. Referring to FIG. 1, a typical prior art paper winding machine is indicated in general at 10. The winding machine contains an unwinding roll 14 from which a paper web 16 is unwound. The paper is fed through the winding machine 10 onto wound roll 18 resting on drums 20 and 21 for supporting the wound roll 18. As wound roll 18 rotates, the paper accumulates onto the roll, and the roll's diameter grows. However, the rotation of wound roll 18 also results in undesirable vibration of the roll.

A rider roll 30 contacts the outer surface of wound roll 18 to steady the wound roll against excessive vibration. At higher rotational speeds, however, the wound roll begins vibrating at increasingly higher magnitudes. Rider roll 30, due to its contact with wound roll 18, thus also vibrates, causing rider roll 30 to lift off of wound roll 18 and lose contact with the wound roll. The still vibrating wound roll 18 then is free to oscillate on drums 20 and 21. This oscillation can produce mechanical wear of the winding equipment, and may even result in wound roll 18 being displaced from drums 20 and 21 entirely, a phenomenon known as "roll kick out." To prevent such occurrences, it is common to employ vibration detection systems to attempt to detect, and limit, the excessive vibration caused by rotation of the wound roll.

As illustrated in FIG. 1, prior attempts to reduce excessive vibration of the wound roll 18 have included measuring the vibration of the rider roll 30 with an instrument such as an accelerometer 46. Typically this vibration signal is read by a detector 48, which is in communication with the drive system 52 of the winding machine and is configured to reduce or even cease the motion of winding machine 10 if vibrations are detected above a certain level. A problem with such prior art systems, however, is that some components of the vibration of the wound roll 18 are caused by sources other than the roll's rotation, such as DC offset, background noise or peripheral vibrations. As a result, the vibration level detector 48 erroneously detects indications of excessive vibration, and thus the drive system 52 of the winding machine 10 is decelerated or halted unnecessarily, resulting in undesirable down time, slower winding times and inefficient performance.

Prior art devices have attempted to control the vibration of the wound roll while reducing unnecessary deceleration or down time in various ways. For example, U.S. Pat. No. 5,909,855 to Jorkama et al. discloses a paper winding method whereby accelerometers measure the vibration of the wound roll or take-up roller of a paper winding machine. As a result, frequency ranges of excessive vibrations may be predetermined by test runs during which the take-up roller is run at various frequencies. During the actual winding operation, when the rotational frequency reaches particular values previously determined to produce excessive vibrations, the running speed of the winding machine is dropped until the rotational frequency of the take-up roller is safely below these frequencies.

A disadvantage of the method and system of the Jorkama et al. '855 patent, however, is that the predetermined frequency ranges of excessive vibrations may become inaccurate if the vibration characteristics of the paper being wound changes. Because the method and system cannot detect such changes, the rotational frequency that causes excessive vibrations may not be successfully avoided. Furthermore, performing preliminary test runs is an inefficient use of time and other resources.

Prior art devices have also used band pass filters and Fast Fourier Transforms to detect winding machine vibrations. For example, U.S. Pat. No. 5,679,900 to Smulders discloses a system for detecting defects in vibrating or rotating paper machinery. The system includes an accelerometer that sends a vibration signal through a band pass filter selected from among several filters. Each filter is set at a different predetermined range of frequencies. The user selects in advance one or more band pass filters according to a desired frequency band, a speed range of winding machinery, or an analyzing range. An envelope detector shapes and enhances the filtered signals before they are subjected to a Fast Fourier Transform (FFT) analysis. While the Smulders '900 patent presents an analysis tool, it does not teach how the results provided thereby may be utilized to control the machinery to prevent excessive vibrations from occurring. In addition, the Smulders '900 patent requires that the user manually select the desired band pass filter, and thus the desired passband.

Accordingly, it is an object of the present invention to provide a vibration detection system that automatically adjusts the winding speed of a machine to avoid intense vibrations of the wound roll due to its rotational speed.

It is a further object of the present invention to provide a vibration detection system whereby the component of wound roll vibration attributable to the rotational speed of the wound roll may be determined so that the winding speed of the winding machine is not unnecessarily decreased.

It is a further object of the present invention to provide a vibration detection system that may be easily installed on existing winding machines.

It is still a further object of the present invention to provide a vibration detection system that provides a low computational burden for the system controller.

SUMMARY OF THE INVENTION

The present invention is a system that provides inputs of a winding machine's wound roll vibration, line speed and wound roll diameter to a programmable controller. The programmable controller uses the line speed and diameter feedback to calculate the rotational frequency of the wound roll as it rotates and accumulates paper. In a first embodiment of the invention, the calculated rotational frequency is used by the programmable controller to select a passband for a band pass filter. By filtering the vibration feedback through the band pass filter, the portion of the vibration of the wound roll not attributable to its rotation is attenuated. A level detector is then used to detect the amplitude of the filtered vibration feedback, that is, the portion of the vibration that is attributable to the rotation of the wound roll. If the detected vibration amplitude exceeds a predetermined level, a signal is sent to the winding machine drive system so that the winding machine is shut down or, alternatively, decelerated until the detected vibration signal is below the predetermined level whereat the wound roll may rotate without experiencing intense vibrations.

In a second embodiment of the invention, a Fast Fourier Transform analysis is performed on the vibration feedback so that a table of vibration amplitudes vs. frequencies is produced. The calculated wound roll rotational frequency is then used to select from the table the amplitude of the vibration at the rotational frequency of the wound roll. This amplitude is compared to a predetermined level in a level detector and, as with the first embodiment, the winding speed of the winding machine is decreased if the predetermined level is exceeded.

DETAILED DESCRIPTION OF THE INVENTION

Figure 1:
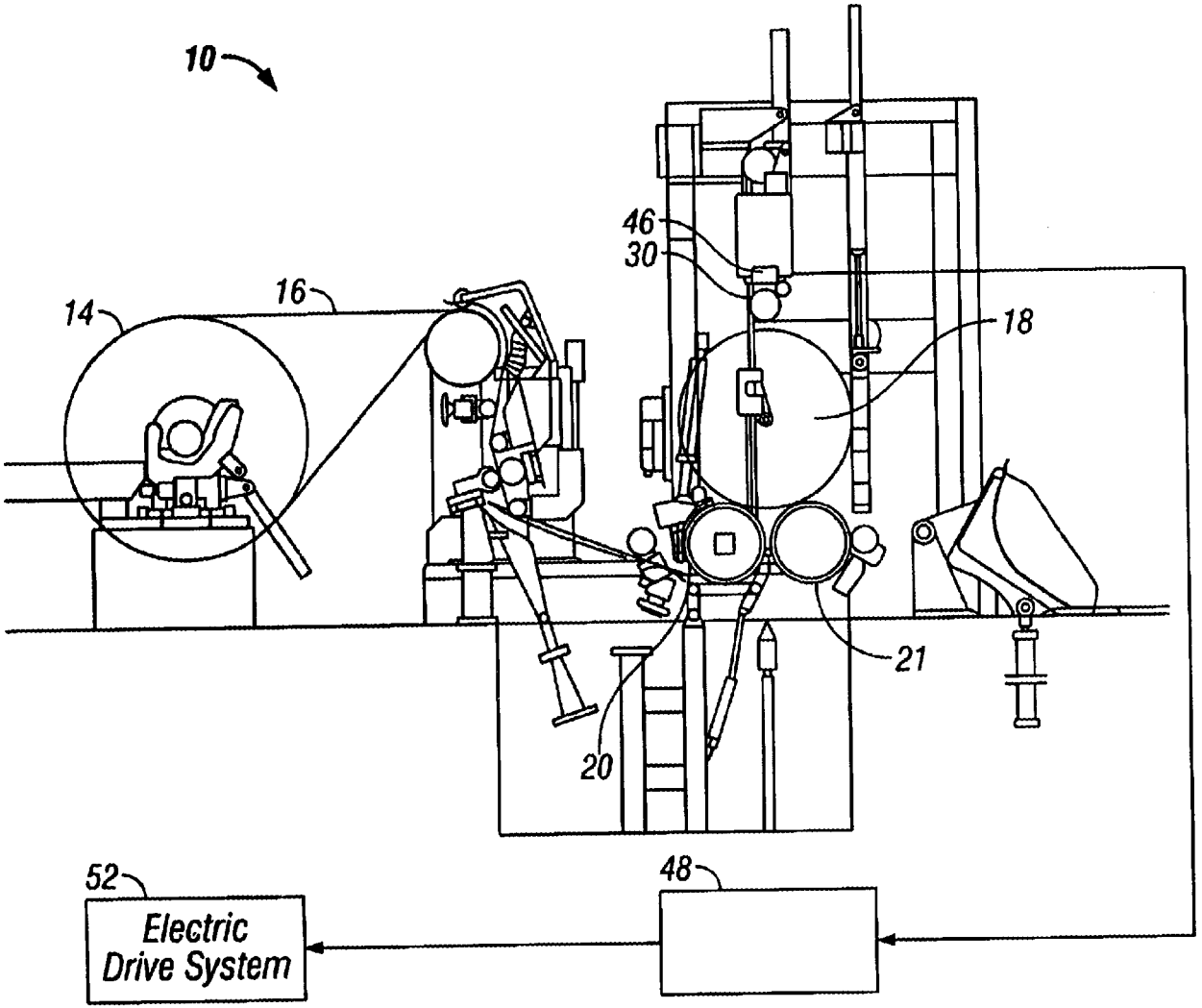
FIG. 1 (Prior Art)
FIG. 1 is an illustration of a typical prior art winding machine.
Figure 2:
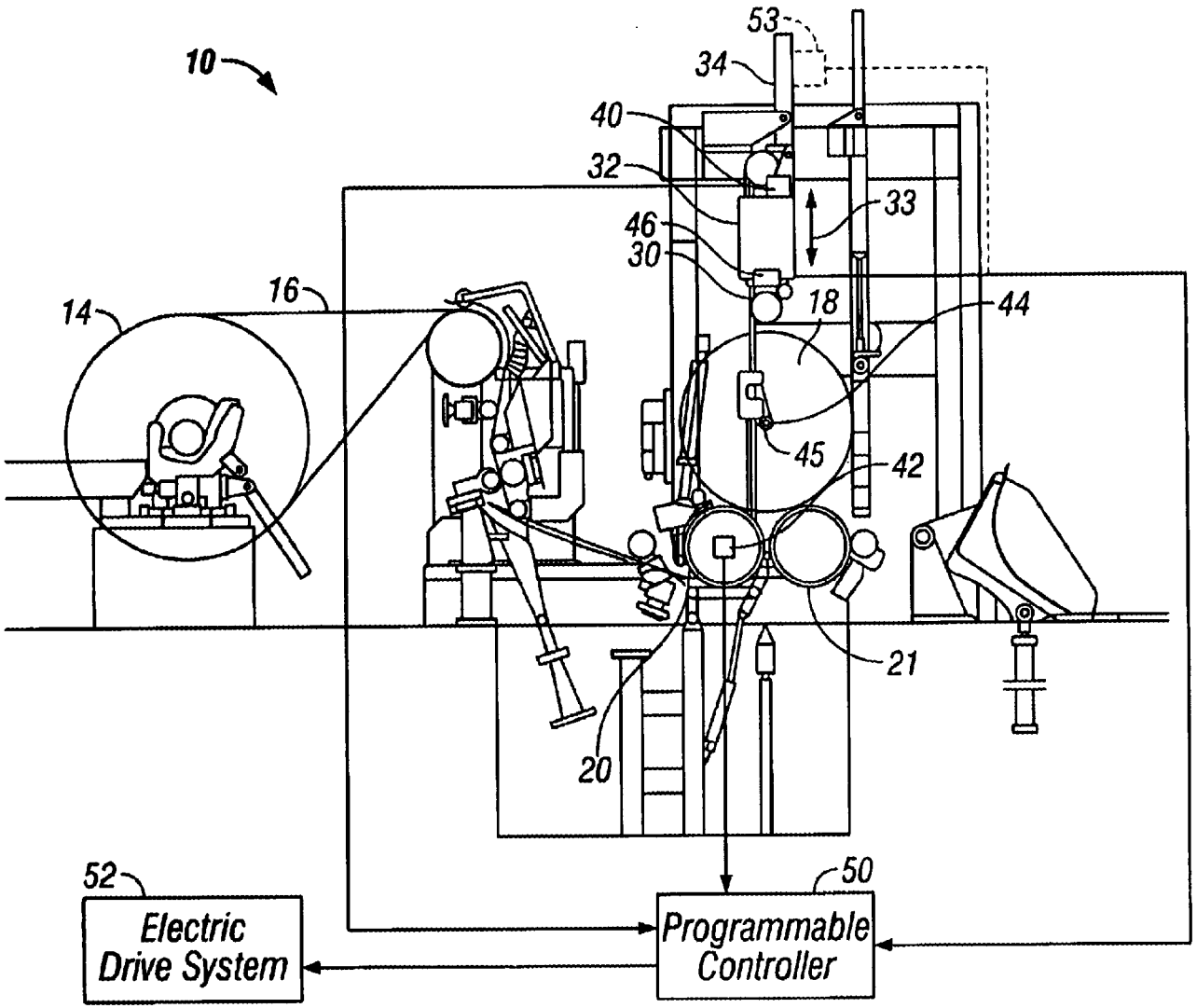
FIG. 2 is an illustration of the winding machine of FIG. 1 equipped with an embodiment of the improved wound roll vibration detection system of the present invention.

Referring to FIG. 2, the paper winding machine 10 from FIG. 1 is shown equipped with a first or time domain embodiment of the improved wound roll vibration detection system of the present invention. It is to be understood that while the present invention is discussed below in terms of a paper winding machine, the present invention may find applications in other industries. For example, the system of the present invention could be implemented on machinery for winding webs of fabric.

Returning to the paper winding machine of FIG. 2, the vibration of wound roll 18 is measured by an accelerometer 46 attached to a rider roll beam 32 used to support rider roll 30. The accelerometer is coupled to a programmable controller 50 for analyzing the measured vibration. Suitable programmable controllers include the model PLC-5 controller manufactured by the Allen-Bradley Company of Milwaukee, Wis. The vibration is represented by a voltage signal which varies dependent upon the acceleration detected by accelerometer 46. The voltage signal is input into an analog input card or other analog to digital converter, preferably present within controller 50, to convert the voltage signal into a stream of numbers for processing. Programmable controller 50 is coupled to an electric drive system 52 for controlling the winding speed of winding machine 10, that is, the rotational speed of wound roll 18.

Alternative methods of determining the vibration of wound roll 18 are possible. For example, a load cell attached to the rider roll beam 32 could be substituted for accelerometer 46. In such an embodiment, the load cell measures the force applied to the rider roll 30 from the vibration of the wound roll 18 and, after accounting for the mass of the rider roll 30 and beam 32, the wound roll vibration is calculated by programmable controller 50. In yet another embodiment, a pressure transducer, illustrated in phantom at 53, is used in place of the accelerometer or load cell and is connected to hydraulic rider roll cylinders 34, which raise and lower rider roll 30 and beam 32 as indicated by arrow 33. The pressure transducer 53 measures pressure variations within hydraulic cylinders 34 resulting from the vibration of the rider roll 30. By accounting for the effective area of the rider roll cylinders 34, as well as the mass of rider roll 30 and beam 32, the wound roll vibration can be calculated. These additional calculations are also performed by programmable controller 50.

In the system of FIG. 2, the programmable controller 50 continuously calculates the rotational frequency of the wound roll 18, and periodically uses this calculated frequency to analyze the vibration signal from accelerometer 46. To calculate the wound roll rotational frequency, the system receives feedback for both the line speed of the paper web 16 as it is wound onto wound roll 18, and diameter of the wound roll 18. To measure the line speed, an encoder 42 is attached to rear drum 20. The wound roll diameter feedback may be obtained with a device such as a rider roll position potentiometer 40 attached to rider roll beam 32 or, alternatively, a one pulse per second revolution sensor 44 disposed on the core chuck 45 holding the core of wound roll 18. In such an embodiment, sensor 44 determines the rotational speed of core chuck 45, which decreases proportionally with the increase in diameter of wound roll 18. The encoder 42 and the device selected for generating wound roll diameter feedback are both coupled to programmable controller 50 for processing the feedback signals.

Due to the diverse methods available for measuring the vibration of wound roll 18, the line speed, and the wound roll diameter, the necessary measuring devices may already be present within a conventional winding machine. In such instances, the improved vibration detection system of the invention may be employable without adding hardware to the winding machine. Indeed, in some circumstances, the implementation of the improved vibration detection system of the present invention may be implemented through a software upgrade to a programmable controller that is already present in the winding machine.

Figure 3:
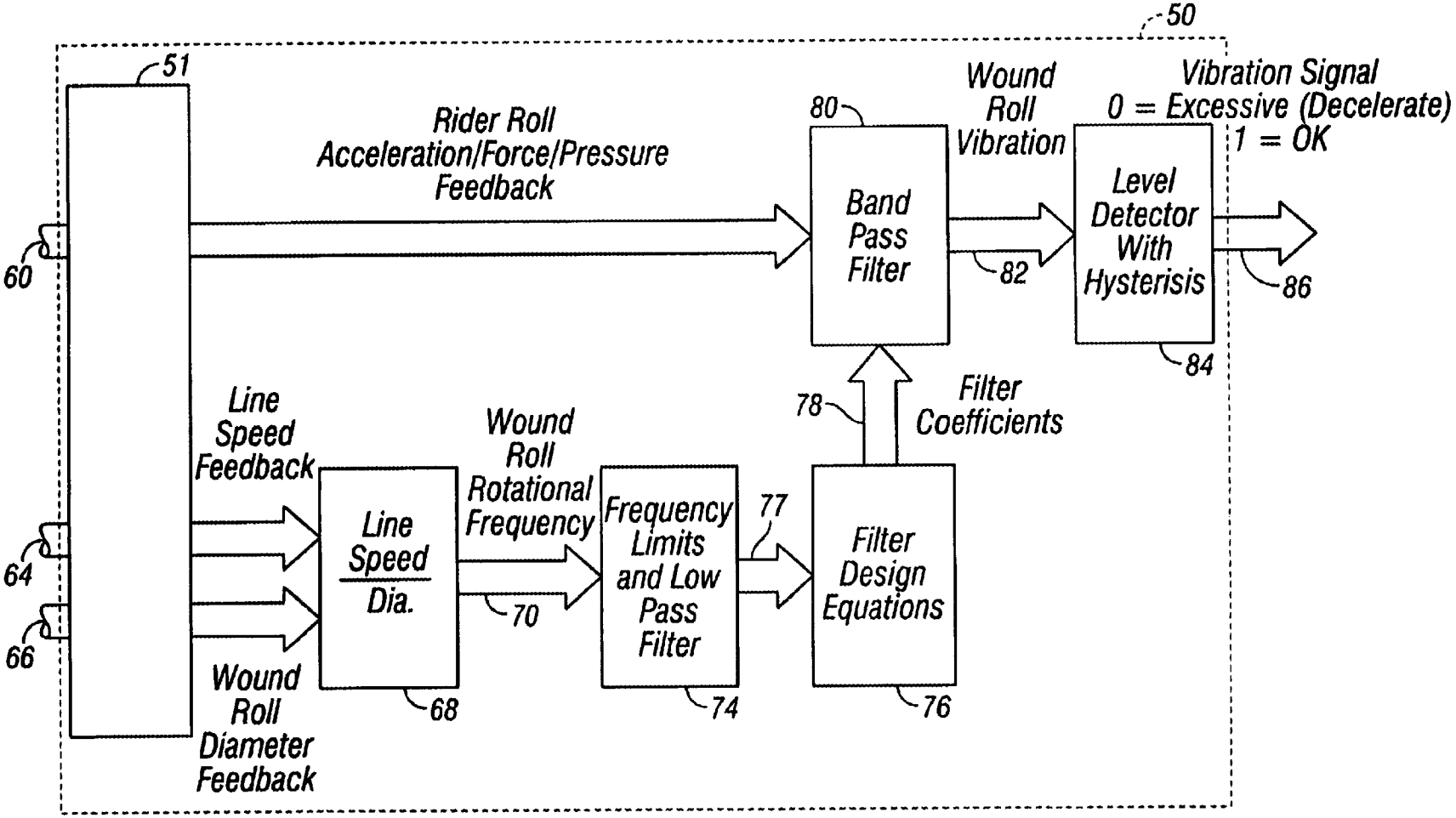
FIG. 3 is a block diagram of the programmable controller of a first embodiment of the improved wound roll vibration detection system of the present invention.

FIG. 3 is a block diagram of the programmable controller 50 of FIG. 2. The programmable controller 50, including an analog input card, and/or pulse counter card, 51, receives feedback input, in the form of varying voltages, for line speed 64 of the paper web (16 in FIG. 2), diameter 66 of the wound roll (18 in FIG. 2) and, as stated previously, vibration feedback 60 for the rider roll (and thus the wound roll).

The analog input card 51 samples each input feedback signal at a predetermined frequency. The sampling frequency needs to be at least twice the highest rotational frequency expected for the wound roll. For example, the maximum rotational frequency for the wound roll could be 25 Hz. For this rotational frequency, the sampling frequency of the analog input card 51 would be 50 Hz, which equates to an update period of 20 msec.

The range of rotational frequencies that can be expected for the wound roll, including the highest expected rotational frequency, may be found with the following equation:

$$f(t) = \frac{v(t)}{\pi\sqrt{d_{core}^2 + \frac{4x}{\pi}\int_0^t v(t)\,dt}}$$

where: f(t)=rotational frequency of the wound roll as a function of time v(t)=line speed of the paper web as a function of time $d_{core}$=diameter of the core of the wound roll x=the average thickness of the paper web The square root term is a relationship well known in the art which can be used to calculate wound roll diameter as a function of the line speed profile, v(t).

The sampled vibration feedback 60, after passing through analog input card 51, is in the form of a stream of numbers and passes through a software band pass filter 80 present within programmable controller 50. Band pass filter 80 is designed to attenuate the portion of the vibration feedback falling outside of a passband centered upon the rotational frequency of the wound roll.

To determine the rotational frequency of the wound roll for the band pass filter 80, programmable controller 50 uses a number from each of the stream of numbers of line speed feedback 64 and wound roll diameter feedback 66 after they have passed through analog input card and/or pulse counter card 51. More specifically, the measured line speed is divided by the measured diameter of the wound roll, as indicated at 68, to calculate a wound roll rotational frequency 70. The calculated rotational frequency signal 70 then enters a frequency limit and low pass filter 74, which limits the signal 70 to the frequency range for which the filter 80 is designed. Filter 74 thus serves as a check in the event of erroneous line speed 64 or diameter 66 feedback data, or in the event of a computational error at 68. An example of an upper frequency limit for filter 74 is 1.0 Hz with a corresponding lower frequency limit of 0.1 Hz.

Filter 74 also corrects feedback signals 64 and 66 if they are corrupted by vibration of the wound roll. This is possible because pure diameter 66 and line speed 64 feedback are very slow changing signals with low frequency components. In contrast, corrupting vibration signals contain relatively high frequency components. As a result, the filter 74 may be programmed such that frequencies above the lower frequency components of the diameter 66 and line speed 64 signals are attenuated. As an example, the filter 74 may be programmed with the following difference equation to accomplish this task:

$$y(k) = \frac{1}{1+\tau}[y(k-1) + \tau x(k)]$$

where: y=output of the filter in Hz x=signal input into the filter in Hz r=a filter constant greater than 0 k=an integer indicating the sample instant

As illustrated at 76, after leaving filter 74, the filtered wound roll rotational frequency signal 77 is used to calculate the filter coefficients 78 for band pass filter 80. Example equations used at 76 to calculate the filter coefficients β, γ, and α for band pass filter 80 are as follows:

$$Q = \frac{f_c}{f_2 - f_1} \quad \beta = \frac{1}{2} * \frac{1 - \tan\left(\frac{\theta_c}{2Q}\right)}{1 + \tan\left(\frac{\theta_c}{2Q}\right)}$$

$$\gamma = \left(\frac{1}{2} + \beta\right)\cos\theta_c \quad \alpha = \frac{1}{4} - \frac{\beta}{2}$$

where: $f_c$=center frequency (=wound roll frequency) in Hz $f_2 - f_1$=the filter pass band width in Hz $T_2$=update period for the filter in seconds Once the values of $f_c$, $f_1$, $f_2$ and $T_s$ are known, the variables $\theta_c$ and Q may be calculated and inserted into the remaining three equations to obtain the filter coefficients. The filter pass band width $f_2$—$f_1$, in Hz, and the update period $T_s$ for the filter are input into the programmable controller 50 by the user. The range for the pass band filter ($f_2 - f_1$,) may be determined by a number of alternative methods. For example, the range may be equivalent to the rotational frequency plus or minus one Hz, in which case $f_2 - f_1$ would be equal to 2. How often the filter coefficients are recalculated may be a set time amount, such as five seconds, or may be dependent upon the changing diameter of the wound roll, for example, every 0.2 inches.

Coefficients β, γand α are used in the following example difference equation for band pass filter 80, which has a passband centered at the calculated rotational frequency of the wound roll.

$$y(k)=2[ax(k)-ax(k-2) +\gamma y(k-1)-\beta y(k-2)]$$

where: y=output of the filter in Hz x=signal input into the filter in Hz

β, γand α=filter coefficients calculated above k=an integer indicating the sample instant The stream of numbers leaving analog input card 51 and representing the vibration of the wound roll is input into the band pass filter 80, and therefore the above difference equation. The result of the band pass filter is a number stream 82, representing a vibration signal that has been attenuated outside the passband. This number stream 82 enters a level detector, indicated at 84, which reads the filtered number stream and outputs a bit stream 86 reflecting whether each number reaching the level detector exceeds a predetermined level (0) or not (1). As a result, in the event of excessive vibration, the bit stream 86 sent to drive system 52 will include a 0 which the drive system 52 will interpret as a signal to decelerate the winding machine, that is, the rotational velocity of the wound roll 18 (FIG. 2).

The level detector 84 may optionally be configured such that hysteresis occurs when the winding machine decelerates. More specifically, the winding machine decelerates when an upper vibration limit is exceeded. When the vibration falls below a lower limit, the winding machine stops decelerating and runs at a constant speed.

Figure 4A:
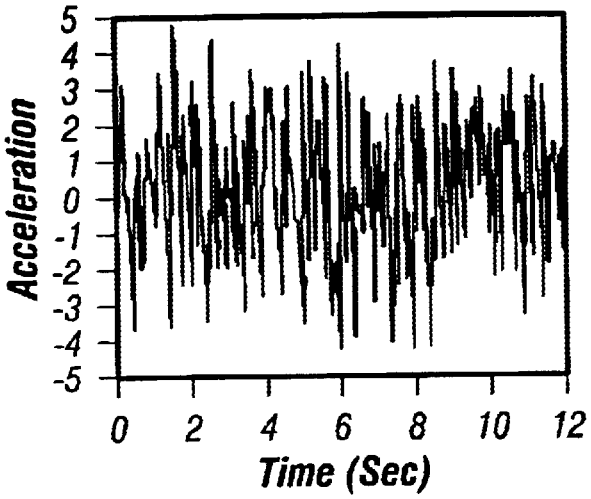
FIG. 4A is a time domain representation of illustrative vibration feedback for a wound roll on a paper winding machine.
Figure 4B:
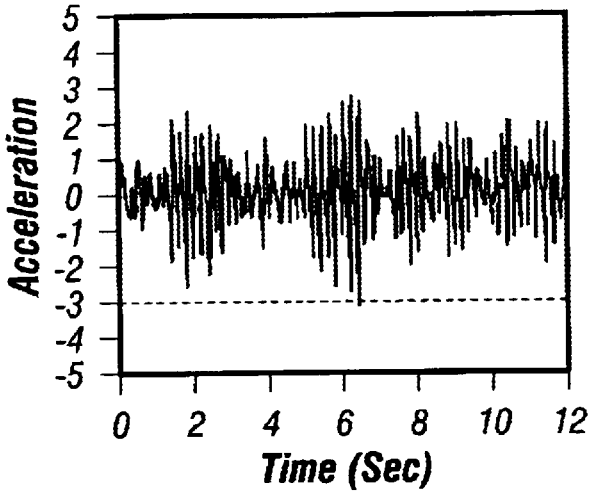
FIG. 4B is a time domain representation of the wound roll vibration feedback of FIG. 4A after passing through the band pass filter of the first embodiment of the system of the present invention.

As an example of the system of FIGS. 2 and 3 in operation, FIG. 4A shows a sample vibration signal from accelerometer 46 plotted in the time domain that contains a 2 Hz component, a 5 Hz component and a noise component. In this example, 5 Hz is the rotational frequency of the wound roll. FIG. 4B shows the example vibration signal after it has been filtered by band pass filter 80 (FIG. 3) with a 5 Hz center frequency ($f_c$) A comparison of FIGS. 4A and 4B reveals that, if an acceleration amplitude of 3 is chosen to be excessive, the filtered signal would indicate excessive vibration once. FIG. 4A reveals that the same level of 3 on the unfiltered signal would cause numerous indications of excessive vibration, most of which are erroneous. Thus, the system of the present invention invites increased sensitivity over prior art methods. The system is easily extendable to handle harmonics of the wound roll frequency by adding additional band pass filters with center frequencies at integer multiples of the wound roll frequency. Furthermore, higher selectivity may be achieved by increasing the order of the filter and using the appropriate design equations as is known in the art.

Figure 6:
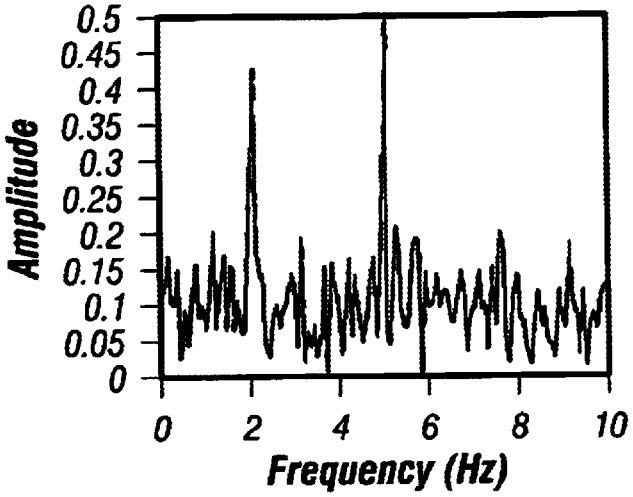
FIG. 6 is a frequency domain representation of the wound roll vibration feedback of FIG. 4A.
Figure 5:
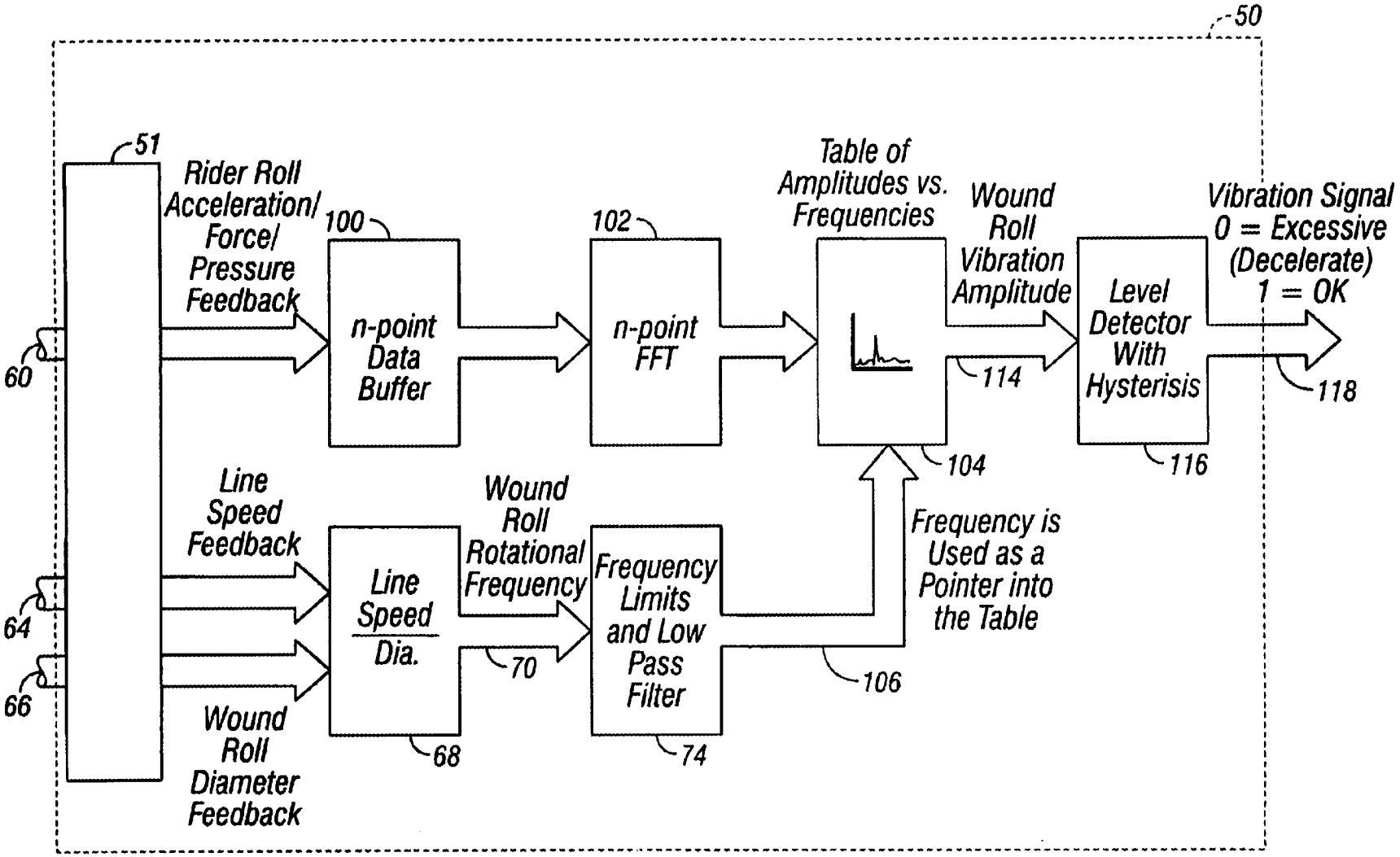
FIG. 5 is a block diagram of the programmable controller of a second embodiment of the wound roll vibration detection system of the present invention.

FIG. 5 is a block diagram of the programmable controller 50 in a second or frequency domain embodiment of the vibration detection system of the present invention. FIG. 2 also applies to this second embodiment. As illustrated in FIG. 5, the rider roll vibration feedback 60 is fed at a predetermined sampling frequency, via analog input card 51, into an n-point data buffer 100, where "n" is an arbitrary integer chosen by the user as the number of data points. Every sample instant, the oldest sample point in the buffer is discarded and a new sample point is added in its place. The sampling frequency, as with the first embodiment of the system, needs to be at least twice the highest rotational frequency expected for the wound roll. The data buffer is used to store the samples for calculation of an n-point Fast Fourier Transform (FFT) analysis as illustrated at 102. As a result of the FFT, a table of amplitudes vs. frequencies, as indicated at 104, is generated. A graphical representation of such a table plotted in the frequency domain, and using the same data selected for the construction of FIG. 4A, is presented as FIG. 6.

The wound roll rotational frequency 70 is calculated, as indicated at 68, from the line speed 64 and wound roll diameter 66 feedback as in the first embodiment of the system of the present invention. In addition, as in the first embodiment of the present invention, the wound roll rotational frequency 70 is routed through frequency limits and low pass filter 74. In the system of FIG. 5, however, the rotational frequency, as indicated at 106, is used as a pointer for the table of amplitudes vs. frequencies 104.

As a result of pointer 106, a vibration amplitude 114 at the wound roll rotational frequency is selected from table 104. The selected amplitude 114 is then input into level detector 116 and a bit stream 118 is generated reflecting whether the signal reaching the level detector 116 exceeds a predetermined level (0) or not (1). Thus, in the event of excessive vibration, the bit stream 118 sent to drive system 52 (FIG. 2) will include a 0 which the drive system 52 will interpret as a signal to decelerate the winding machine, that is, the rotational velocity of the wound roll 18 (FIG. 2).

When programming controller 50, a desired frequency resolution for the FFT calculation 102 must be determined. The frequency resolution is the ability to display discretely the amplitudes of the wound roll vibration feedback signal in terms of frequency for the table 104 produced by the FFT 102. The frequency resolution is related to the number of sample points taken by data buffer 100. More specifically, the more sample points (larger values of n) taken, the greater the frequency resolution.

A high number of arithmetic operations may be necessary to do an FFT calculation at a desirable sampling frequency and frequency resolution with the embodiment of FIG. 5. For example, if the maximum wound roll rotational frequency is 25 Hz and a frequency resolution of 0.2 Hz is desired for table 104, then the number of amplitude points produced by the FFT calculation would need to be 25/0.2= 125. For computational efficiency, the value should be rounded up to the nearest power of 2, that is, 128. When the FFT calculation 102 takes place, half of the points are symmetric. As a result, a 256 point FFT would need to be calculated to get 128 amplitude points in table 104. A 256 point FFT would require 10240 arithmetic operations (multiplications and additions). On a programmable controller such as the Allen-Bradley PLC-5, this would take roughly 150 msecs which is approximately three times greater than the required sample period. As such, programmable controller 50 in FIG. 5 preferably is supplemented or replaced with a DSP board. The DSP board may be part of a personal computer used as programmable controller 50.

With the embodiment of FIG. 5, there may be several predetermined amplitude levels in the level detector 116 at integer multiples of the wound roll rotational frequency. In such a system, the amplitudes at these harmonic frequencies are compared with the predetermined levels and if any are exceeded, the winding machine is decelerated. As with the embodiment of FIG. 3, the level detector 116 may also be configured so that hysteresis occurs when the winding machine is decelerated.

The present invention thus provides a system which isolates the vibration of a wound roll in a winding machine to the vibration caused by the rotation of the wound roll for accurate and useful detection by a level detector. This reduces false trips of the level detector and increases the tolerance of the system to noise. In this way, the winding machine is automatically commanded to decelerate only when necessary thus improving the efficiency of the winding operation.

It will be understood by those of ordinary skill in the art that the foregoing is intended to illustrate the preferred embodiments of the invention. Various modifications are possible within the scope of the invention as set forth in the appended claims.

What is claimed is:

1. A system for controlling the winding speed of a machine for winding a web of material onto a wound roll comprising:

a) means for measuring a vibration of the wound roll as web material is wound thereon;

b) means for measuring a line speed of the web of material;

c) means for measuring a diameter of the wound roll;

d) a controller receiving the measured line speed and diameter and calculating a wound roll rotational frequency therefrom and using the calculated wound roll rotational frequency to isolate the component of said vibration of the wound roll due to the winding speed of the winding machine; and e) a level detector in communication with the winding machine, said level detector decreasing the winding speed of the winding machine if the winding speed component of the wound roll vibration exceeds a pre-determined level;

whereby excessive vibration of the wound roll is avoided.

2. The system of claim 1 wherein the controller includes a band pass filter with a passband that isolates the component of the wound roll vibration that is due to the winding speed of the winding machine, the passband of said band pass filter determined by the calculated wound roll rotational frequency.

3. The system of claim 1 wherein the controller is programmed to perform a Fast Fourier Transform analysis on the measured vibration of the wound roll so that a table of amplitudes vs. frequencies is produced and the isolated component of the wound roll vibration is selected from the table based upon the calculated wound roll rotational frequency.

4. The system of claim 3 wherein the controller includes an analog to digital converter in communication with the means for measuring a vibration of the wound roll and a data buffer in communication with the analog to digital converter, said data buffer storing sample points provided by the analog to digital converter for use in the Fast Fourier Transform analysis.

5. The system of claim 1 wherein the winding machine includes a rider roll engaging the wound roll and the means for measuring the vibration of the wound roll includes an accelerometer in communication with the rider roll and the controller.

6. The system of claim 1 wherein the winding machine includes a rider roll engaging the wound roll and the means for measuring the vibration of the wound roll includes a load cell in communication with the rider roll and the controller.

7. The system of claim 1 wherein the winding machine includes a rider roll engaging the wound roll and a rider roll hydraulic cylinder attached to the rider roll and the means for measuring the vibration of the wound roll includes a pressure transducer in communication with the rider roll hydraulic cylinder and the controller.

8. The system of claim 1 wherein the winding machine includes a rear drum supporting the wound roll and the means for measuring the line speed of the web of material includes an encoder in communication with the rear drum and the controller.

9. The system of claim 1 wherein the winding machine includes a rider roll engaging the wound roll and the means for measuring a diameter of the wound roll includes a position potentiometer in communication with the rider roll and the controller.

10. The system of claim 1 wherein the winding machine includes a core chuck engaging the wound roll and the means for measuring a diameter of the wound roll includes a revolution sensor in communication with the core chuck.

11. The system of claim 1 wherein the controller includes an analog to digital converter in communication with the means for measuring the vibration, line speed and diameter.

12. The system of claim 1 wherein the controller includes a low pass filter for filtering the calculated wound roll rotational frequency.

13. The system of claim 1 wherein the level detector is incorporated into the controller.

14. A machine for winding a web of material onto a wound roll comprising:

a) a drive system dictating a winding speed of the machine;

b) means for measuring a vibration of the wound roll as web material is wound thereon;

c) means for measuring a line speed of the web of material;

d) means for measuring a diameter of the wound roll;

e) a controller receiving the measured line speed and diameter and calculating a wound roll rotational frequency therefrom and using the calculated wound roll rotational frequency to isolate the component of said vibration of the wound roll due to the winding speed of the winding machine; and f) a level detector in communication with the drive system and the controller, said level detector decreasing the winding speed if the winding speed component of the wound roll vibration exceeds a pre-determined level; whereby excessive vibrations of the wound roll are avoided.

15. The machine of claim 14 wherein the controller includes a band pass filter with a passband that isolates the component of the wound roll vibration that is due to the winding speed, the passband of said band pass filter determined by the calculated wound roll rotational frequency.

16. The machine of claim 14 wherein the controller is programmed to perform a Fast Fourier Transform analysis on the measured vibration of the wound roll so that a table of amplitudes vs. frequencies is produced and the isolated component of the wound roll vibration is selected from the table based upon the calculated wound roll rotational frequency.

17. The machine of claim 16 wherein the controller includes an analog to digital converter in communication with the means for measuring a vibration of the wound roll and a data buffer in communication with the analog to digital converter, said data buffer storing sample points provided by the analog to digital converter for use in the Fast Fourier Transform analysis.

18. The machine of claim 14 wherein the means for measuring the vibration of the wound roll includes a rider roll engaging the wound roll and an accelerometer in communication with the rider roll and the controller.

19. The machine of claim 14 wherein the means for measuring the vibration of the wound roll includes a rider roll engaging the wound roll and a load cell in communication with the rider roll and the controller.

20. The machine of claim 14 wherein the means for measuring the vibration of the wound roll includes a rider roll engaging the wound roll, a rider roll hydraulic cylinder attached to the rider roll and a pressure transducer in communication with the rider roll hydraulic cylinder and the controller.

21. The machine of claim 14 further comprising a rear drum supporting the wound roll and wherein the means for measuring the line speed of the web of material includes an encoder in communication with the rear drum and the controller.

22. The machine of claim 14 further comprising a rider roll engaging the wound roll and wherein the means for measuring a diameter of the wound roll includes a position potentiometer in communication with the rider roll and the controller.

23. The machine of claim 14 further comprising a core chuck engaging the wound roll and wherein the means for measuring a diameter of the wound roll includes a revolution sensor in communication with the core chuck.

24. The machine of claim 14 wherein the controller includes an analog to digital converter in communication with the means for measuring the vibration, line speed and diameter.

25. The machine of claim 14 wherein the controller includes a low pass filter for filtering the calculated wound roll rotational frequency.

26. The machine of claim 14 wherein the level detector is incorporated into the controller.

27. A method for winding a web of material onto a wound roll so that excessive vibrations of the wound roll are avoided comprising the steps of:

a) measuring a vibration of the wound roll;

b) measuring a line speed of the web of material as it is wound onto the wound roll;

c) measuring a diameter of the wound roll;

d) calculating a wound roll rotational frequency from the measured line speed and the measured diameter of the wound roll;

e) isolating a component of the measured vibration of the wound roll based upon the calculated wound roll rotational frequency;

f) comparing the isolated component of the wound roll vibration to a pre-determined level; and g) decreasing a winding speed of the wound roll when the isolated component of the wound roll vibration exceeds the pre-determined level.

28. The method of claim 27 wherein step e) includes the substeps of:

i) providing a band pass filter;

ii) selecting a passband for the band pass filter based upon the calculated rotational frequency; and iii) filtering the measured vibration of the wound roll with the band pass filter.

29. The method of claim 27 wherein step e) includes the substeps of:

i) performing a Fast Fourier Transform analysis so that a table of amplitudes vs. frequencies is produced; and ii) selecting the isolated component of the wound roll vibration from the table based upon the calculated wound roll rotational frequency.

30. The method of claim 27 further comprising the steps of:

h) providing a low pass filter; and i) filtering the wound roll rotational frequency calculated in step d) with the low pass filter.

* * * * *